US005316999A

United States Patent [19]

Hayashi et al.

[11] Patent Number: 5,316,999

[45] Date of Patent: May 31, 1994

[54] THERMAL TRANSFER DYE IMAGE-RECEIVING SHEET

[75] Inventors: Shigeo Hayashi, Kawasaki; Osamu Kohari; Masaru Kato, both of Tokyo, all of Japan

[73] Assignee: Oji Paper Co., Ltd., Tokyo, Japan

[21] Appl. No.: 753,593

[22] Filed: Sep. 3, 1991

[30] Foreign Application Priority Data

Sep. 3, 1990 [JP] Japan ..... 2-230543
Oct. 18, 1990 [JP] Japan ..... 2-277909
Apr. 26, 1991 [JP] Japan ..... 3-096953

[51] Int. Cl.[5] ..... B41M 5/035; B41M 5/38

[52] U.S. Cl. ..... 503/227; 428/195; 428/423.1; 428/500; 428/522; 428/913; 428/914

[58] Field of Search ..... 8/471; 428/195, 500, 428/913, 914, 423.1, 522; 503/227

[56] References Cited

U.S. PATENT DOCUMENTS 4,840,870 6/1989 Iwagaki et al. ..... 430/201

FOREIGN PATENT DOCUMENTS 02-29391 1/1990 Japan ..... 503/227

OTHER PUBLICATIONS

JP-A-2184494 (Richoh KK), Jul. 18, 1990, Abstract.
JP-A-1255591 (Richoh KK), Oct. 12, 1989, Abstract.

*Primary Examiner*—B. Hamilton Hess
*Attorney, Agent, or Firm*—Armstrong, Westerman, Hattori, McLeland & Naughton

[57] ABSTRACT

A thermal transfer dye image-receiving sheet capable of receiving thereon dye images thermally transferred from a dye sheet at a high color depth and a high sensitivity without a melt-adhesion thereof to a dye sheet, comprises a image-receiving resinous layer formed on a substrate sheet and comprising a copolymer of 60% by weight or more of vinyl chloride with 40% by weight or less of a comonomeric component including, as an indispensable compound, vinyl propionate, which copolymer optionally further comprises at least one other comonomeric compound having a hydroxyl, carboxyl, amino, reactive methylene or reactive methane group and cross-linked with a polyfunctional compound having two or more isocyanate, epoxy or methylol groups.

10 Claims, No Drawings

THERMAL TRANSFER DYE IMAGE-RECEIVING SHEET

BACKGROUND OF THE INVENTION

1) Field of the Invention

The present invention relates to a thermal transfer dye image-receiving sheet. More particularly, the present invention relates to a thermal transfer dye image-receiving sheet capable of recording clear dye images thermally transferred from a dye sheet in a high color depth at a high sensitivity.

2) Description of the Related Arts

Currently there is an enormous interest in the rapid development of new types of thermal transfer color image printer, for example, a color and copier, capable of recording high quality color images by a dye thermal transfer system.

In the dye thermal transfer printer, colored images are formed by superimposing a dye ink sheet composed of a substrate sheet and a yellow, cyan or magenta dye ink layer formed on the substrate sheet, and comprising a mixture of a sublimating dye with a binder on a dye image-receiving sheet composed of a dye image-receiving resinous layer formed on a substrate sheet in such a manner that the dye ink layer surface of the dye ink sheet is brought into direct contact with the dye image-receiving resinous layer of the dye image-receiving sheet, and the dye ink layer is locally heated by a thermal head of a printer, to thermally transfer the yellow, cyan or magenta dye images to the dye image-receiving resinous layer. In this thermal transfer of the colored images, the heating of the thermal head is continuously controlled in accordance with electrical signals corresponding to the pattern of images to be recorded, and the amount of dye transferred from the dye ink layer to the image-receiving resinous layer is continuously controlled in accordance with the amount of heat, and heating time, applied by the thermal head, to thereby print out continuous tone full color images having a desired color depth (darkness) on the image-receiving resinous layer.

To record high quality colored images having an excellent clarity on the image-receiving sheet, it is necessary to provide a dye image-receiving resinous layer which will not be melt-adhered to the dye ink sheet, is capable of receiving dye images having a high resistance to light and heat, at a high transferring speed, and exhibits a high affinity to and capacity for receiving the thermally transferred dye.

In particular, the thermal transfer dye image-receiving sheet usable for the dye thermal transfer recording system must be provided with an image receiving layer comprising, as an active principle, a thermoplastic resin capable of being dyed with a sublimating dye supplied from a dye ink sheet.

For example, Japanese Unexamined Patent Publication No. 60-24,996 discloses an image-receiving sheet having an image-receiving resinous layer comprising a polyvinyl chloride resin which contains a plasticizer, and thus is capable of receiving dye images with a high color depth and a high color fastness to light.

Nevertheless, it should be noted that the dye images recorded on an image-receiving sheet must have not only a high color depth and light fastness but also a high resistance to heat and to diffusion, and an excellent storage durability.

Generally, in the production of the image-receiving sheet, a coating liquid is prepared by dissolving or dispersing a dye-receiving resin in an organic solvent and then applying the resultant solution to a surface of a substrate sheet by a customary coating device, for example, a mayer bar, to thus form an image-receiving resinous layer. In view of the above-mentioned process, the dye-receiving resin must have a high solubility or dispersibility in the organic solvent, but the polyvinyl chloride resin has an unsatisfactory solubility in the organic solvent and is disadvantageous in that the plasticizer easily oozes out to the outer surface of the dye-receiving resinous layer. Accordingly, an improvement of the properties of the polyvinyl chloride resin for the image-receiving resinous layer is needed.

In another example, Japanese Unexamined Patent Publication No. 63-51,181 discloses an image-receiving resinous layer comprising, as an active principle, a vinyl chloride and vinyl acetate-based copolymer. This image-receiving resinous layer effectively enhances the light fastness of the dye images received thereon, but has an unsatisfactory dye-receiving sensitivity.

In still another example, Japanese Unexamined Patent Publication discloses an image-receiving resinous layer comprising a cross-linked thermoplastic polyester resin having an enhanced resistance to melt adhesion, but this melt adhesion resistance has proved unsatisfactory when the thermal head used has a special form and a temperature imparted to the image-receiving resinous layer by the thermal heat or the ambient temperature is relatively high.

SUMMARY OF THE INVENTION

An object of the present invention is to provide a thermal transfer dye image-receiving sheet capable of receiving dye images thermally transferred from a dye ink sheet with a high color depth and an excellent sensitivity, without a melt-adhering thereof to the dye ink sheet.

Another object of the present invention is to provide a thermal transfer dye image-receiving sheet capable of receiving dye images having an excellent resistance to light and heat and an enhanced storage durability, at a high speed.

Still another object of the present invention is to provide a thermal transfer dye image-receiving sheet having a high dye-receiving capacity and capable of firmly fixing thermally transferred dye images thereon without an undesirable diffusion of the dye.

The above-mentioned objects can be attained by the thermal transfer dye image-receiving sheet of the present invention which comprises a substrate sheet; and an image-receiving resinous layer formed on at least one surface of the substrate sheet and comprising a resinous material capable of receiving thermally transferred dye images, said resinous material comprising, as an active principle, a vinyl chloride and vinyl propionate-based copolymer resin which comprises a copolymerization product of 60% by weight or more of vinyl chloride with 40% by weight or less of a comonomeric component including, as an indispensable comonomeric compound, vinyl propionate, and has a glass transition temperature of 40° C. or more.

The vinyl chloride and vinyl propionate-based copolymer resin optionally has at least one functional group selected from the group consisting of hydroxyl, carboxyl, amino, activated methylene and activated methane groups and is cross-linked with a cross-linking agent comprising at least one compound having two or more functional groups selected from the group consisting of isocyanate, epoxy and methylol groups.

In a preferable embodiment of the thermal transfer dye image-receiving sheet of the present invention, the comonomeric component contains, in addition to vinyl propionate, at least one ethylenically unsaturated compound having at least one group reactive with isocyanate groups, and the resultant vinyl chloride and vinyl propionate-based copolymer resin is cross-linked with at least one polyisocyanate compound.

In another preferable embodiment of the thermal transfer dye-image-receiving sheet of the present invention, the vinyl chloride and vinyl propionate-based copolymer resin satisfies the following relationships (I) and (II):

$$DP \geqq 250 \text{ and} \quad \text{(I)}$$

$$\Delta YI_1 \leqq 4 \quad \text{(II)}$$

wherein DP represents a number average degree of polymerization of the vinyl chloride and vinyl propionate-based copolymer resin, and ΔYI represents a difference ($YI_1 - YI_0$) between a yellowing factor $YI_1$ of the vinyl chloride-vinyl propionate copolymer heat-treated at a temperature of 80° C. for 100 hours, and an original yellowing factor $YI_0$ of the non-heat treated copolymer, the yellowing factors $YI_1$ and $YI_0$ being determined in accordance with Japanese Industrial Standard (JIS) K 7103.

DESCRIPTION OF THE PREFERRED EMBODIMENTS

In the thermal transfer dye image-receiving sheet of the present invention, the dye-receiving resinous material in the image-receiving resinous layer must comprise, as an active principle, a specific vinyl chloride and vinyl propionate-based copolymer resin. This specific copolymer resin has a glass transition temperature of 40° C. or more and comprises a copolymerization product of 60% by weight or more, preferably 60 to 98% by weight, of vinyl chloride with 40% by weight or less, preferably 2 to 40% by weight of a comonomeric component including, as an indispensable comonomeric compound, vinyl propionate.

The above-mentioned specific vinyl chloride and vinyl propionate-based copolymer resin made a major contribution to the ability of the resultant image-receiving resinous layer to exhibit a high sensitivity and capacity for receiving dye images thermally transferred and an enhanced anti-fuse-adhering property to a dye ink sheet, and the received dye images to exhibit an enhanced color depth, an excellent resistance to light and heat, and an improved storage durability.

The substrate sheet usable for the present invention comprises a member selected from single sheet materials, for example, fine paper sheets, coated paper sheets, thermoplastic resin films such as polyester films, synthetic paper sheets consisting of at least one monoaxially or biaxially oriented film comprising a polyolefin resin, for example, a polyethylene resin, polypropylene resin or ethylene-propylene copolymer resin, and an inorganic pigment, for example, titanium dioxide, calcium carbonate or clay, and laminate sheets composed of two or more of the above-mentioned sheets and films, for example, laminated paper sheets having an extrusion-coated layer comprising a mixture of a polyolefin resin and an inorganic pigment.

The substrate sheet usable for the present invention preferably has a thickness of from 20 to 250 μm and a basis weight of from 20 to 250 g/m$^2$.

The vinyl chloride and vinyl propionate-based copolymer resin is produced by copolymerizing vinyl chloride and the comonomeric component including vinyl propionate in the presence of a radical-initiating agent, for example, benzoyl peroxide or benzophenon which generates reaction-initiating radicals, by applying heat, ultraviolet rays or an electron beam, by a suspension polymerization method, bulk polymerization method, emulsion polymerization method or solution polymerization method.

The copolymerization system must contain vinyl chloride and vinyl propionate.

Also, the comonomeric component optionally comprises, in addition to vinyl propionate, at least one additional ethylenically unsaturated compound copolymerizable with vinyl chloride and vinyl propionate. The additional ethylenically unsaturated compound is preferably selected from vinyl carboxylate esters other than vinyl propionate, for example, vinyl acetate and vinyl versatate; acrylic monomers, for example, acrylic acid methacrylic acid, methyl acrylate, ethyl acrylate, butyl acrylate, methyl methacrylate, ethyl methacrylate, butyl methacrylate, 2-hydroxyethyl acrylate, 2-(2-hydroxyethoxy)ethyl acrylate, 2-hydroxycyclohexyl acrylate, and 2-hydroxy-2-phenylethyl acrylate; maleic esters, for example, ethyl maleate and dibutyl maleate.

After the copolymerization is completed a portion of ester groups in the resultant vinyl chloride and vinyl propionate-based copolymer may be converted to hydroxyl groups by a saponification method.

The vinyl chloride and vinyl propionate-based copolymer resin optionally comprises a further additional comonomer selected from methacrylic esters, maleic acid, maleic esters, vinyl ether derivatives, vinylidene chloride, acrylonitrile, methacrylonitrile and styrene in a small amount of 30% or less based on the total weight of the comonomeric component.

Preferably, the vinyl chloride and vinyl propionate-based copolymer comprises 60 to 98% by weight of vinyl chloride, 2 to 40% by weight of vinyl propionate and 0 to 30% by weight of at least one additional ethylenically unsaturated compound.

The vinyl chloride and vinyl propionate-based copolymer resin of the present invention has a glass transition temperature of 40° C. or more preferably 50° C. to 60° C., and preferably has a number average molecular weight of 2000 or more.

If the glass transition temperature is less than 40° C., the resultant image-receiving resinous layer exhibits an unsatisfactory heat-resistance, dye-receiving property and storage durability.

The resinous material of the image-receiving resinous layer consists of the vinyl chloride and vinyl propionate-based copolymer resin alone, or a mixture of the vinyl chloride and vinyl propionate-based copolymer with at least one additional resin selected from polyester resins, acrylic resins, polycarbonate resins, polyvinyl chloride resins and polyvinyl acetate resins in a small amount of 30% or less based on the above-mentioned copolymer resin.

The vinyl chloride and vinyl propionate-based copolymer resin usable for the present invention optionally has at least one functional group selected from the group consisting of, for example, hydroxyl, carboxyl, amino, activated methylene and activated methane groups and is cross-linked with a cross-linking agent comprising at least one compound having two or more functional groups selected from the group consisting of, for example, isocyanate, epoxy and methylol groups.

In the preparation of the vinyl chloride and vinyl propionate-based copolymer having the functional radicals, vinyl chloride and vinyl propionate are copolymerized with at least one ethylenically unsaturated compound having the functional groups, for example, a vinyl carboxylate ester, acrylic monomer or maleic ester.

The compounds having the cross-linking functional groups include polyisocyanate compounds, for example, tolylene diisocyanate, triphenylmethane-p,p',p''-triisocyanate and polymethylene polyisocyanates; and polyepoxy compounds.

Preferably, the cross-linking agent is used in an amount of 1% to 20%, preferably 1% to 10%, based on the total weight of the image-receiving resinous layer. If the amount of the cross-linking agent is more than 20%, the resultant cross-linked resinous material exhibits an excessively increased hardness and a decreased dye-receiving capacity and sensitivity. Also, if the amount is less than 1%, the cross-linking effect on the resinous material is unsatisfactory.

To enhance the releasing property of the image-receiving resinous layer from the dye ink sheet during the thermal transfer procedure, the image-receiving resinous layer preferably contains a releasing agent comprising at least one member selected from, for example, paraffin, waxes, for example, polyethylene waxes; metal soaps, silicone oils, amino-modified silicones, epoxy-modified silicones, alcohol-modified silicones, silicone resins, silicone varnishes, fluorine-containing surfactants, fluorine-containing polymer resins, and phosphoric esters. The releasing agent is contained preferably in a content of 10% or less based on the total weight of the image-receiving resinous layer.

In the image-receiving resinous layer of the present invention, the resinous material is optionally admixed with at least one customary additive selected from, for example, antioxidants, ultraviolet absorbants, and sensitizing agents. Also, the resinous material is optionally admixed with a white pigment, which effectively increases the whiteness and opacity, and a fluorescent pigment or dye or blue or violet pigment or dye which are useful for controlling the color tone and brightness of the image-receiving resinous layer.

Generally, the above-mentioned additives are almost all mixed with the resinous material and applied to the substrate sheet to form an image-receiving resinous layer, but some of the additives, for example, an ultraviolet absorbant, are optionally coated, separately from the resinous material, on the image-receiving resinous layer or between the substrate sheet and the image-receiving resinous layer.

Preferably, the image-receiving resinous layer of the present invention is present in a basis weight of 2 to 20 $g/m^2$, more preferably 4 to 10 $g/m^2$. When the basis weight is too low, the resultant image-receiving resinous layer exhibits an undesirably poor sensitivity and a low color depth of the received images. Also, if the basis weight is too high, the resultant image-receiving resinous layer exhibits a saturated dye image-receiving capacity, which is uneconomical, and has a reduced mechanical strength.

It is well known, not only in the field of the thermal transfer printing sheets but also in the fields of other printing sheets, that an antistatic agent is added to the image-receiving resinous sheet or coated on the front or back surface of the substrate sheet to prevent an undesirable static electrification of the printing sheets. The antistatic agent is optionally applied to the thermal transfer dye-image receiving sheet of the present invention, and is selected from cationic, anionic and nonionic antistatic agents.

In an embodiment of the thermal transfer dye image-receiving sheet of the present invention, the comonomeric component to be copolymerized with vinyl chloride contains, in addition to vinyl propionate, at least one ethylenically unsaturated compound having at least one functional group reactive with isocyanate groups, and the resultant vinyl chloride and vinyl propionate-based copolymer resin is cross-linked with at least one polyisocyanate compound having two or more isocyanate radicals.

The functional groups reactive with isocyanate groups include groups having at least one activated hydrogen atom, for example, a hydroxyl group, carboxyl group, amino group, and activated methylene group.

The ethylenically unsaturated compound having functional groups reactive with isocyanate groups is preferably selected from the group consisting of hydroxyl groups-containing acrylic compounds, for example, 2-hydroxyethyl acrylate, 2-(2-hydroxyethoxy)-ethyl acrylate, 2-hydroxycyclohexyl acrylate, 2-hydroxy-2-phenylethyl acrylate, 2-hydroxybutyl acrylate, 4-hydroxybutyl acrylate, 2-hydroxypropyl acrylate, 3-hydroxypropyl acrylate, 2-hydroxy-2-methylpropyl acrylate, 2-hydroxyethyl methacrylate, 2-hydroxypropyl methacrylate and 3-hydroxybutyl acrylate; amino group-containing ethylenically unsaturated compounds, for example, aminocarboxylmethyl acrylate, aminovinylethyl acrylate and vinylbenzyl amine; and carboxyl group-containing ethylenically unsaturated compounds, for example, acrylic acid, methacrylic acid and maleic acid.

The vinyl chloride and vinyl propionate-based copolymer in this embodiment, is preferably a copolymerization product of 60% by weight, preferably, 60 to 98% by weight of vinyl chloride with 1 to 40%, preferably, 10 to 30%, of vinyl propionate and 1 to 30%, preferably 2 to 20%, of at least one ethylenically unsaturated compound having functional groups reactive with isocyanate groups. Note, the total amount of the vinyl propionate and the ethylenically unsaturated compound reactive with isosyanate groups is not more than 40% by weight.

The copolymer resin optionally contains at least one ethylenically unsaturated compound other than vinyl chloride, vinyl propionate and the above-mentioned functional compound, in a small content of 5% by weight or less.

The functional compound-containing vinyl chloride and vinyl propionate-based copolymer resin of the present invention has a number average molecular weight of 2000 or more and a glass transition temperature of 40° C. This functional compound-containing vinyl chloride and vinyl propionate-based copolymer resin can be employed as a simple resin or a resin mixed with an additional resin, for example, polyester, acrylic, and other resins.

In this embodiment the functional compound-containing vinyl chloride and vinyl propionate-based copolymer resin is cross-linked with a cross-linking agent comprising at least one polyisocyanate compound selected from, for example, tolylene diisocyanate, triphenylmethane-p,p',p''-triisocyanate, polymethylene polyisocyanate, and reaction products of the above-mentioned polyisocyanates with trimethylol propane.

The polyisocyanate compound is preferably used in an amount of 1 to 20%, preferably 1 to 10%, based on the total weight of the image-receiving resinous layer, for the same reasons as mentioned above.

In another embodiment of the thermal transfer dye image-receiving sheet of the present invention, the vinyl chloride and vinyl propionate-based copolymer resin preferably satisfies the following relationship (I) and (II), $$DP \geqq 250 \text{ and} \quad \text{(I)}$$

$$\Delta YI_1 \leqq 4 \quad \text{(II)}$$

in which relationship (I) and (II) DP represents a number average degree of polymerization of the vinyl chloride and vinyl propionate-based copolymer resin, and $\Delta YI$ represents a difference ($YI_1 - YI_0$) between a yellowing factor $YI_1$ of the vinyl chloride and vinyl propionate-based copolymer resin after being heat treated at a temperature of 80° C. for 100 hours, and an original yellowing factor $YI_0$ of the non-heat treated copolymer; the yellowing factors $YI_1$ and $YI_0$ being determined in accordance with Japanese Industrial Standard (JIS) K 7103.

Generally, a yellowing factor (YI) of a resinous material is determined by a spectrophotometric analysis in which a standard light C is irradiated onto the resinous material and tristimulus values X, Y and Z are measured, and the yellowing factor (YI) is calculated from the measured tristimulus values X, Y and Z in accordance with the equation (III):

$$YI = [100 \times (1.28X - 1.06Z)]/Y \quad \text{(III)}$$

When the vinyl chloride and vinyl propionate-based copolymer resin satisfies the relationship (I) and (II), the resultant image-receiving resinous layer is advantageous in that the dye images received thereon have an excellent light fastness, the printing operation can be carried out at a high speed, without an undesirable reduction in the color depth of the received dye images, non-image portions of the dye-image transferred resinous layer can be maintained at a high brightness even when the image-receiving sheet is stored under a high temperature condition for a long time, and the contrast between the image portions and non-image portions remains satisfactory.

EXAMPLES

The present invention will be further explained with reference to the following specific examples, which are representative and do not in any way restrict the scope of the present invention.

In the examples, the dyeing (dye-receiving) property and storage durability of the thermal transfer dye image-receiving sheet were tested and evaluated in the following manner.

Dyeing Property Test

A thermal transfer dye image-receiving sheet was printed by a sublimating dye thermal transfer printer available under the trademark of Color Video Printer VY-P1 from Hitachi Ltd., in a full color tone pattern by superimposing yellow, magenta and cyan images one upon the other.

In this printing operation, the dot density was 8 dots/mm, the input applied to the thermal head was 1 W/dot, and the pulse width was 15 mm.

The quality (greatest color depth, and sensitivity) of the printed colored images and the release of the image-receiving resinous layer from the dye ink sheet were tested.

In the sensitivity test, the color depth of the full color tone images transferred under a low energy was measured.

In the releasing property test, the quality (clarity and evenness) of the thermally transferred images in the full color tone pattern was observed and evaluated by the naked eye.

Storage Durability

The storage durability of colored images thermally transferred to the image-receiving resinous layer was tested for the following items.

Light Fastness

The colored images were exposed to a xenon fade meter, at a temperature of 50° C. and a relative humidity of 63%, for 48 hours, and changes in the color depth and hue of the colored images were, observed and evaluated by the naked eye.

Heat Resistance

The printed sheet was stored in an air dryer at a temperature of 60° C. for 200 hours, and changes in the color depth and hue of the colored images were observed and evaluated by the naked eye. Also, the diffusion of the dye images was observed and evaluated by the naked eye.

The naked eye-observation test results were evaluated and indicated as follows.

| Class | Evaluation |
|---|---|
| 5 | Excellent |
| 4 | Good |
| 3 | Satisfactory |
| 2 | Not satisfactory |
| 1 | Bad |

Yellowing Factor

A resinous material was formed into a film having a thickness of 40±10 μm, and the film was heat-treated in an air drier at a temperature of 80° C. for 100 hours. The heat treated film, as well as a non-heat-treated original film, was subjected to the determination of the yellowing factors $YI_1$ and $YI_0$ in accordance with JIS K 7103.

The resistance to yellowing was classified as follows.

| Class | Evaluation | |
|---|---|---|
| 5 | $2 > \Delta YI$ | Excellent |
| 4 | $4 \geqq \Delta YI \geqq 2$ | Good |
| 3 | $6 > \Delta YI > 4$ | Not good |

-continued

| Class | Evaluation | |
|---|---|---|
| 2 | 8 > ΔYI ≧ 6 | Bad |
| 1 | ΔYI ≧ 8 | Very bad |

EXAMPLE 1

A laminate paper sheet composed of a base fine paper sheet with a basis weight of 64 g/m$^2$, and front and back coating layers formed on the front and back surfaces of the base sheet, and each comprising a polyethylene resin and having a thickness of 30 μm, was employed as a substrate sheet.

A coating liquid (1) was prepared as the following composition.

| Component | Amount (part by weight) |
|---|---|
| Vinyl chloride-vinyl propionate copolymer (*)$_1$ | 100 |
| Amino-modified silicone oil(*)$_2$ | 5 |
| Toluene | 200 |
| Methylethylketone | 200 |

Note:
(*)$_1$ . . . This copolymer had a vinyl chloride content of 80% by weight and a glass transition temperature (Tg) of 60° C., and is available under the trademark of Ryulon QC-720, from Toso Co.
(*)$_2$ . . . Available under the trademark of KF-393 from Shinetsu Silicone Co.

The coating liquid (1) was coated on the front surface of the substrate sheet, to thus form an image-receiving resinous layer having a dry solid weight of 5 g/m$^2$.

The resultant thermal transfer dye image-receiving sheet was subjected to the above-mentioned tests, and the test results are shown in Table 1.

EXAMPLE 2

The same procedures as in Example 1 were carried out except that the image-receiving resinous layer was formed from a coating liquid (2) having the following composition.

| Component | Amount (part by weight) |
|---|---|
| Vinyl chloride-vinyl propionate copolymer (*)$_3$ | 100 |
| KF-393(*)$_2$ | 5 |
| Toluene | 200 |
| Methylethylketone | 200 |

Note:
(*)$_3$ . . . This copolymer had a vinyl chloride content of 60% by weight and a Tg of 52° C., and was available under the trademark of Ryulon QC-640 from Toso Co.

The test results of the resultant thermal transfer dye image-receiving sheet are shown in Table 1.

EXAMPLE 3

The same procedures as in Example 1 were carried out except that the image-receiving resinous layer was formed from a coating liquid (3) having the following composition.

| Component | Amount (part by weight) |
|---|---|
| Vinyl chloride-vinyl propionate copolymer (*)$_4$ | 100 |
| KF-393(*)$_2$ | 5 |
| Toluene | 200 |

-continued

| Component | Amount (part by weight) |
|---|---|
| Methylethylketone | 200 |

Note:
(*)$_4$ . . . This copolymer had a vinyl chloride content of 70% by weight and a Tg of 56° C., and was available under the trademark of Ryulon QC-730K from Toso Co.

The test results of the resultant thermal transfer dye image-receiving sheet are shown in Table 1.

COMPARATIVE EXAMPLE 1

The same procedures as in Example 1 were carried out except that the image-receiving resinous layer was formed from a coating liquid (4) having the following composition.

| Component | Amount (part by weight) |
|---|---|
| Polyvinyl chloride(*)$_5$ | 100 |
| KF-393(*)$_2$ | 5 |
| Tetrahydrofuran | 1000 |

Note:
(*)$_5$ . . . This was a chemical reagent available from Kako Junyaku K.K.

The test results of the resultant thermal transfer dye image-receiving sheet are shown in Table 1.

COMPARATIVE EXAMPLE 2

The same procedures as in Example 1 were carried out except that the image-receiving resinous layer was formed from a coating liquid (5) having the following composition.

| Component | Amount (part by weight) |
|---|---|
| Polyvinyl chloride(*)$_5$ | 100 |
| KF-393(*)$_2$ | 5 |
| Dioctyl adipate (plasticizer) | 2 |
| Tetrahydrofuran | 1000 |

The test results of the resultant thermal transfer dye image-receiving sheet are shown in Table 1.

COMPARATIVE EXAMPLE 3

The same procedures as in Example 1 were carried out except that the image-receiving resinous layer was formed from a coating liquid (6) having the following composition.

| Component | Amount (part by weight) |
|---|---|
| Polyester resin(*)$_6$ | 100 |
| KF-393(*)$_2$ | 5 |
| Toluene | 200 |
| Methylethylketone | 200 |

Note:
(*)$_6$ . . . This polyester resin was available under the trademark of Vylon 200 from Toyobo Ltd.

The test results of the resultant thermal transfer dye image-receiving sheet are shown in Table 1.

COMPARATIVE EXAMPLE 4

The same procedures as in Example 1 were carried out except that the image-receiving resinous layer was formed from a coating liquid (7) having the following composition.

| Component | Amount (part by weight) |
|---|---|
| Vinyl chloride-vinyl acetate copolymer (*)$_7$ | 100 |
| KF-393(*)$_2$ | 5 |
| Toluene | 200 |
| Methylethylketone | 200 |

Note:
(*)$_7$ . . . This copolymer was available under the trademark of Denkavinyl #1000AS from Denki Kagaku Kogyo K.K.

The test results of the resultant thermal transfer dye image-receiving sheet are shown in Table 1.

TABLE 1

| Example No. | Copolymer resin: Content of vinyl chloride (% wt.) | Copolymer resin: Tg (°C.) | Properties of image-receiving sheet: Highest color depth | Sensitivity | Releasing property | Light fastness | Heat resistance |
|---|---|---|---|---|---|---|---|
| Example | | | | | | | |
| 1 | 80 | 60 | 4 | 4 | 5 | 5 | 5 |
| 2 | 60 | 52 | 5 | 5 | 5 | 5 | 5 |
| 3 | 70 | 56 | 4 | 4 | 5 | 5 | 5 |
| Comparative Example | | | | | | | |
| 1 | 100 | — | 2 | 1 | 2 | 4 | 4 |
| 2 | 100 | — | 3 | 3 | 3 | 3 | 1 |
| 3 | (*)$_6$ | — | 4 | 5 | 1 | 3 | 4 |
| 4 | (*)$_7$ | — | 3 | 3 | 4 | 5 | 5 |

EXAMPLE 4

Preparation of Dye Ink Sheet

A polyester film having a thickness of 6 μm was coated on a front surface thereof with a heat-resistant material consisting of a silicone oil, and further, coated on a back surface thereof with a dye ink solution having the following composition, by using a mayer bar, to form a dye ink layer having a dry thickness of 1 μm.

| Component | Amount (part by weight) |
|---|---|
| Disperse dye (*)$_8$ | 4 |
| Polyvinyl butylol resin(*)$_9$ | 6 |
| Toluene | 45 |
| Methylethylketone | 45 |

Note:
(*)$_8$ . . . Trademark: Kayaset Blue 136, made by Nihon Kayaku K.K.
(*)$_9$ . . . Trademark: BM-S, made by Sekisui Kagaku K.K.

Preparation of Thermal Transfer Dye Image-Receiving Sheet

A laminate paper sheet composed of a base fine paper sheet having a basis weight of 120 g/m$^2$ and laminated on two surfaces thereof, each with a polyethylene layer having a thickness of 30 μm, was employed as a substrate sheet.

A coating liquid (8) was prepared in the following composition.

| Component | Amount (part by weight) |
|---|---|
| Vinyl chloride and vinyl propionate-based copolymer resin(*)$_{10}$ | 100 |
| Polyisocyanate compound(*)$_{11}$ | 5 |
| Toluene | 200 |
| Methylethylketone | 200 |

Note:
(*)$_{10}$ . . . This was a copolymer of vinyl chloride (60% by weight), vinyl propionate (30% by weight), and hydroxyl group-containing comonomer (10% by weight) had a Tg of 47° C., and available under the trademark of Ryulon QX842 from Toso Co.
(*)$_{11}$ . . . Trademark: Colonate L, made by Nihon Polyurethane Co.

The coating liquid (8) was coated on the front surface of the substrate sheet to provide an image-receiving resinous layer having a dry solid weight of 5 g/m$^2$.

The resultant thermal transfer dye image-receiving sheet was subjected to the same tests as mentioned above, except that the printing operation was carried out by using the above-mentioned dye ink sheet at a dot density of 8 dots/mm, at an input of 1 W/dot and at a pulse width of 15 mm.

The test results are indicated in Table 2.

EXAMPLE 5

The same procedures as in Example 4 were carried out except that the image-receiving resinous layer was formed from a coating liquid (9) having the following composition.

| Component | Amount (part by weight) |
|---|---|
| Vinyl chloride and vinyl propionate-based copolymer resin(*)$_{12}$ | 100 |
| Colonate L(*)$_{11}$ | 5 |
| Toluene | 200 |
| Methylethylketone | 200 |

Note:
(*)$_{12}$ . . . This was a copolymer of vinyl chloride (70% by wt.), vinyl propionate (20% by wt.) and carboxyl group-containing comonomer (10% by wt.), had a Tg of 57° C. and was available under the trademark of Ryulon QA-433 from Toso Co.

The test results of the resultant thermal transfer dye image-receiving sheet are shown in Table 2.

COMPARATIVE EXAMPLE 5

The same procedures as in Example 4 were carried out except that the image-receiving resinous layer was formed from a coating liquid (10) having the following composition.

| Component | Amount (part by weight) |
|---|---|
| Polyvinyl chloride(*)$_5$ | 100 |
| Dioctyl adipate (plasticizer) | 2 |
| Tetrahydrofuran | 900 |

The test results of the resultant thermal transfer dye image-receiving sheet are shown in Table 2.

COMPARATIVE EXAMPLE 6

The same procedures as in Example 4 were carried out except that the image-receiving resinous layer was formed from a coating liquid (11) having the following composition.

| Component | Amount (part by weight) |
|---|---|
| Vylon 200(*)$_6$ | 100 |
| Colonate L(*)$_{11}$ | 5 |
| Toluene | 200 |
| Methylethylketone | 200 |

The test results of the resultant thermal transfer dye image-receiving sheet are shown in Table 2.

TABLE 2

| | Item Properties of image-receiving sheet | | | | |
|---|---|---|---|---|---|
| | | | | Heat resistance | |
| Example No. | Color depth | Releasing property | Light fastness | Resistance to fading | Resistance to dye diffusion |
| Example | | | | | |
| 4 | 5 | 5 | 4 | 5 | 4 |
| 5 | 5 | 5 | 5 | 5 | 5 |
| Comparative Example | | | | | |
| 5 | 5 | 3 | 5 | 2 | 1 |
| 6 | 5 | 2 | 2 | 5 | 5 |

EXAMPLE 6

A laminate paper sheet composed of a base fine paper sheet having a basis weight of 150 g/m$^2$ and laminated on two surfaces thereof, each with a polyethylene layer having a thickness of 30 μm, was employed as a substrate sheet.

A coating liquid (12) was prepared as the following composition.

| Component | Amount (part by weight) |
|---|---|
| Vinyl chloride and vinyl propionate based copolymer resin (*)$_{13}$ | 100 |
| KF-393(*)$_2$ | 5 |
| Toluene | 200 |
| Methylethylketone | 200 |

Note:
(*)$_{13}$ . . . This is a copolymer of vinyl chloride (70% by wt.) with vinyl propionate (30% by wt.), having a degree of polymerization of about 470 and a Tg of 57° C., and available under a trademark of Ryulon QA-431, from Toso Co.

The coating liquid (12) was coated on the front surface of the substrate sheet to provide an image-receiving resinous layer having a dry solid weight of 5 g/m$^2$.

The resultant thermal transfer dye image-receiving sheet was subjected to the above-mentioned tests, and the test results are indicated in Table 3.

EXAMPLE 7

The same procedures as in Example 6 were carried out except that the image-receiving resinous layer was formed from a coating liquid (13) having the following composition.

| Component | Amount (part by weight) |
|---|---|
| Vinyl chloride and vinyl propionate-based copolymer resin (*)$_{14}$ | 100 |
| KF-393(*)$_2$ | 5 |
| Toluene | 200 |
| Methylethylketone | 200 |

Note:
(*)$_{14}$ . . . This was a copolymer of vinyl chloride (60% by wt.) and vinyl propionate (40% by wt.), had a Tg of 61° C., and a degree of polymerization of about 300, and was available under the trademark of Ryulon QN-503 from Toso Co.

The test results of the resultant thermal transfer dye image-receiving sheet are shown in Table 3.

EXAMPLE 8

The same procedures as in Example 6 were carried out except that the image-receiving resinous layer was formed from a coating liquid (14) having the following composition.

| Component | Amount (part by weight) |
|---|---|
| Ryulon QX 842(*)$_{10}$ | 100 |
| KF-393(*)$_2$ | 5 |
| Toluene | 200 |
| Methylethylketone | 200 |

The test results of the resultant thermal transfer dye image-receiving sheet are shown in Table 3.

COMPARATIVE EXAMPLE 7

The same procedures as in Example 6 were carried out except that the image-receiving resinous layer was formed from a coating liquid (15) having the following composition.

| Component | Amount (part by weight) |
|---|---|
| Vinyl chloride-vinyl propionate copolymer (*)$_{15}$ | 100 |
| KF-393(*)$_2$ | 5 |
| Toluene | 200 |
| Methylethylketone | 200 |

Note:
(*)$_{15}$ . . . This copolymer had a content of vinyl chloride of 70% by weight, a degree of polymerization of about 150 and a Tg of 59° C., and was available under the trademark of Ryulon QC-7 from Toso Co.

The test results of the resultant thermal transfer dye image-receiving sheet are shown in Table 3.

COMPARATIVE EXAMPLE 8

The same procedures as in Example 6 were carried out except that the image-receiving resinous layer was formed from a coating liquid (16) having the following composition.

| Component | Amount (part by weight) |
|---|---|
| Vinyl chloride and vinyl propionate-based copolymer resin (*)$_{16}$ | 100 |

-continued

| Component | Amount (part by weight) |
|---|---|
| KF-393(*)$_2$ | 5 |
| Toluene | 200 |
| Methylethylketone | 200 |

Note:
(*)$_{16}$ . . . This copolymer had a vinyl chloride content of 80% by weight and a Tg of 60° C. and was available under the trademark of Ryulon QC-720 from Toso Co.

The test results of the resultant thermal transfer dye image-receiving sheet are shown in Table 3.

COMPARATIVE EXAMPLE 9

The same procedures as in Example 6 were carried out except that the image-receiving resinous layer was formed from a coating liquid (17) having the following composition.

| Component | Amount (part by weight) |
|---|---|
| Vinyl chloride-vinyl acetate copolymer (*)$_{17}$ | 100 |
| KF-393(*)$_2$ | 5 |
| Toluene | 200 |
| Methylethylketone | 200 |

Note:
(*)$_{17}$ . . . This copolymer had a degree of polymerization of about 630 and a Tg of 59° C. and was available under the trademark of #1000MT$_3$ from Denki Kagaku Kogyo K.K.

The test results of the resultant thermal transfer dye image-receiving sheet are shown in Table 3.

COMPARATIVE EXAMPLE 10

The same procedures as in Example 6 were carried out except that the image-receiving resinous layer was formed from a coating liquid (18) having the following composition.

| Component | Amount (part by weight) |
|---|---|
| Polyester resin(*)$_{18}$ | 100 |
| KF-393(*)$_2$ | 5 |
| Colonate L(*)$_{11}$ | 5 |
| Toluene | 200 |
| Methylethylketone | 200 |

Note:
(*)$_{18}$ . . . This polyester resin had a molecular weight of 20,000 to 25,000 and a Tg of 77° C., and was available under the trademark of Vylon 290 from Toyobo Ltd.

The test results of the resultant thermal transfer dye image-receiving sheet are shown in Table 3.

TABLE 3

| | Item Properties of image-receiving sheet | | | | |
|---|---|---|---|---|---|
| Example No. | Highest color depth | Sensitivity | Resistance to yellowing | Light fastness | Heat resistance |
| Example | | | | | |
| 6 | 5 | 5 | 5 | 5 | 5 |
| 7 | 5 | 5 | 4 | 5 | 5 |
| 8 | 5 | 5 | 4 | 5 | 5 |
| Comparative Example | | | | | |
| 7 | 5 | 5 | 2 | 5 | 3 |
| 8 | 5 | 5 | 2 | 5 | 5 |
| 9 | 3 | 3 | 4 | 4 | 5 |
| 10 | 5 | 5 | 3 | 2 | 5 |

The relationship between the degree of polymerization (DP) and the ΔYI is indicated in Table 4.

TABLE 4

| | Item Dye-receiving resin | | | |
|---|---|---|---|---|
| Example No. | Type | | Degree of polymerization (DP) | ΔYI |
| Example | | | | |
| 6 | QA 431 | (*)$_{13}$ | 470 | 1.3 |
| 7 | QN 503 | (*)$_{14}$ | 300 | 3.7 |
| 8 | QX 842 | (*)$_{10}$ | 250 | 3.3 |
| Comparative Example | | | | |
| 7 | QC 7 | (*)$_{15}$ | 150 | 6.1 |
| 8 | QC-720 | (*)$_{16}$ | — | 6.1 |
| 9 | 1000 MT$_3$ | (*)$_{17}$ | 630 | 3.5 |
| 10 | Vylon 290 | (*)$_{18}$ | Molecular weight 20,000–25,000 | 4.5 |

We claim:

1. A thermal transfer dye image-receiving sheet comprising:

a substrate sheet; and an image-receiving resinous layer formed on at least one surface of the substrate sheet and comprising a resinous material capable of receiving thermally transferred dye images, said resinous material comprising, as an active principle, a vinyl chloride and vinyl propionate-based copolymer resin which comprises a copolymerization product of 60% to 98% by weight of vinyl chloride with 2% to 40% by weight of vinyl propionate, and having a glass transition temperature of 40° C. or more, and said vinyl chloride and vinyl propionate-based copolymer resin satisfying the following relationships (I) and (II):

$$DP \geqq 250 \text{ and} \quad (I)$$

$$\Delta YI \leqq 4 \quad (II)$$

wherein DP represents a number average degree of polymerization of the vinyl chloride and vinyl propionate-based copolymer resin, and ΔYI represents a difference ($YI_1 - YI_0$) between a yellowing factor $YI_1$ of the vinyl chloride and vinyl propionate-based copolymer resin heat treated at a temperature of 80° C. for 100 hours, and an original yellowing factor $YI_0$ of the non-heat treated copolymer, the yellow factors $YI_1$ and $YI_0$ being determined in accordance with Japanese Industrial Standard (JIS) K 7103.

2. The image-receiving sheet as claimed in claim 1, wherein the comonomeric component contains, in addition to vinyl propionate, 30% by weight or less of at least one additional ethylenically unsaturated compound selected from the group consisting of vinyl acetate, acrylic acid, methacrylic acid, methyl acrylate, ethyl acrylate, butyl acrylate, methyl methacrylate, ethyl methacrylate, butyl methacrylate, 2-hydroxyethyl acrylate, 2-(2-hydroxyethoxy)ethyl acrylate, 2-hydroxycyclohexyl acrylate, 2-hydroxy-2-phenylethyl acrylate, ethyl maleate, and dibutyl maleate.

3. The image-receiving sheet as claimed in claim 1, wherein the vinyl chloride and vinyl propionate-based copolymer has a number average molecular weight of 2000 or more.

4. The image-receiving sheet as claimed in claim 1, wherein the vinyl chloride and vinyl propionate-based copolymer resin has at least one functional group selected from the group consisting of hydroxyl, carboxyl, amino, activated methylene, and activated methane groups, and is cross-linked with a cross-linking agent comprising at least one compound having two or more functional groups selected from the group consisting of isocyanate, epoxy, and methylol groups.

5. The image-receiving sheet as claimed in claim 4, wherein the cross-linking agent is in an amount of 1% to 20% based on the total weight of the image-receiving resinous layer.

6. The image-receiving sheet as claimed in claim 1, wherein the comonomeric component contains, in addition to vinyl propionate, at least one ethylenically unsaturated compound having at least one group reactive with isocyanate groups, and the resultant vinyl chloride and vinyl propionate-based copolymer resin is cross-linked with at least one polyisocyanate compound.

7. The image-receiving sheet as claimed in claim 6, wherein the polyisocyanate compound is selected from the group consisting of tolylene diisocyanate, triphenylmethane-p,p',p''-triisocyanate, polyethylenepolyisocyanates, and reaction products of the above-mentioned polyisocyanate compounds with trimethylolpropane.

8. The image-receiving sheet as claimed in claim 6, wherein the ethylenically unsaturated compound reactive with isocyanate groups is selected from the group consisting of 2-hydroxyethyl acrylate, 2-(2-hydroxyethoxy)ethyl acrylate, 2-hydroxycyclohexyl acrylate, 2-hydroxy-2-phenylethyl acrylate, 2-hydroxybutyl acrylate, 4-hydroxybutyl acrylate, 2-hydroxypropyl acrylate, 3-hydroxypropyl acrylate, 2-hydroxy-2methylpropyl acrylate, 2-hydroxyethyl methacrylate, 2-hydroxypropyl methacrylate, 3-hydroxybutyl acrylate, aminocarboxymethyl acrylate, amino vinylethyl acrylate, vinylbenzylamine, acrylic acid, methacrylic acid, maleic acid.

9. The image-receiving sheet as claimed in claim 6, wherein, in the vinyl chloride and vinyl propionate-based copolymer, the vinyl chloride is present in an amount of 60% by weight or more, the vinyl propionate is present in an amount of 1% to 39% by weight and the ethylenically unsaturated compound reactive with isocyanate groups is present in an amount of 1% to 30% by weight, the total amount of the vinyl propionate and the ethylenically unsaturated compound reactive with isocyanate groups being not more than 40% by weight 10. The image-receiving sheet as claimed in claim 6, wherein the polyisocyanate compound is used in an amount of 1% to 20% based on the total weight of the image-receiving resinous layer.

* * * * *